US011772768B1

(12) United States Patent
Jesewitz et al.

(10) Patent No.: US 11,772,768 B1
(45) Date of Patent: Oct. 3, 2023

(54) AXIAL FLUX PROPULSION SYSTEM FOR AN ELECTRIC BOAT

(71) Applicant: EVOA, LLC, Orlando, FL (US)

(72) Inventors: Raymond L. Jesewitz, Apopka, FL (US); Michael J. Anderson, Orlando, FL (US)

(73) Assignee: EVOA, LLC, Orlando, FL (US)

( * ) Notice: Subject to any disclaimer, the term of this patent is extended or adjusted under 35 U.S.C. 154(b) by 192 days.

(21) Appl. No.: 17/226,579

(22) Filed: Apr. 9, 2021

Related U.S. Application Data

(63) Continuation-in-part of application No. 17/120,106, filed on Dec. 11, 2020, now abandoned.

(60) Provisional application No. 62/946,478, filed on Dec. 11, 2019.

(51) Int. Cl.

| | |
|---|---|
| ***B63H 21/17*** | (2006.01) |
| ***B63H 21/38*** | (2006.01) |
| ***B63H 21/21*** | (2006.01) |
| ***B63H 23/06*** | (2006.01) |

(52) U.S. Cl.
CPC ..... *B63H 21/17* (2013.01); *B63H 21/21* (2013.01); *B63H 21/383* (2013.01); *B63H 23/06* (2013.01)

(58) Field of Classification Search
CPC ..... B63H 21/17; B63H 21/21; B63H 21/383; B63H 23/06
See application file for complete search history.

(56) References Cited

U.S. PATENT DOCUMENTS

| | | | | |
|---|---|---|---|---|
| 1,534,725 A * | 4/1925 | Macmillan | B63H 23/24 415/60 |
| 6,396,161 B1 * | 5/2002 | Crecelius | B63H 21/21 322/1 |
| 2009/0209146 A1 * | 8/2009 | Jegel | B63H 21/17 903/904 |
| 2013/0233230 A1 * | 9/2013 | Rohden | B63B 27/00 318/8 |
| 2022/0169349 A1 * | 6/2022 | Jesewitz | B63H 11/08 |

FOREIGN PATENT DOCUMENTS

| | | | |
|---|---|---|---|
| WO | WO-2009082808 A1 * | 7/2009 | B60K 6/46 |

* cited by examiner

*Primary Examiner* — Stephen P Avila
(74) *Attorney, Agent, or Firm* — Lewis Rice LLC

(57) ABSTRACT an Axial Flux Propulsion System for an Electric Boat which includes interconnecting subsystems including a mounting system, a traction system, a transmission system, an electrical power distribution system, a control system, and a fluid management system among other boat systems. The traction system being an axial flux motor/generator.

11 Claims, 15 Drawing Sheets

| | |
|---|---|
| **AXIAL FLUX MOTOR - OPERATION MODES** | |
| OPERATION MODE | **100% ELECTRIC** |
| **1. IN NEUTRAL - READY STATE** | (T0) |
| ICE | NONE |
| CLUTCH 1 | NONE |
| CLUTCH2 | NONE |
| MOTOR 1-TRACTION/ GEN | OFF |
| MOTOR 2 - TRACTION/ GEN | OFF |
| BATTERY STATE | STEADY |
| **2. IDLE SPEED (< 5 mph)** | (T1) |
| ICE | NONE |
| CLUTCH 1 | NONE |
| CLUTCH2 | NONE |
| MOTOR 1-TRACTION/ GEN | TRACTION ON |
| MOTOR 2 - TRACTION/ GEN | TRACTION OFF |
| BATTERY STATE | DISCHARGING |
| **3. ACCELERATION (0 - 40 mph)** | (T2) |
| ICE | NONE |
| CLUTCH 1 | NONE |
| CLUTCH2 | NONE |
| MOTOR 1-TRACTION/ GEN | TRACTION ON |
| MOTOR 2 - TRACTION/ GEN | TRACTION ON |
| BATTERY STATE | DISCHARGING |

FIG. 9A

| AXIAL FLUX MOTOR - OPERATION MODES | |
|---|---|
| **OPERATION MODE** | **100% ELECTRIC** |
| **4. WAKESURF MODE I -** | (T3) |
| **(all electric ~12 mph)** | |
| ICE | NONE |
| CLUTCH 1 | NONE |
| CLUTCH2 | NONE |
| MOTOR 1-TRACTION/ GEN | TRACTION ON |
| MOTOR 2 - TRACTION/ GEN | TRACTION ON |
| BATTERY STATE | DISCHARGING |
| **5. WAKESURF MODE II -** | (T3) |
| **(~12 mph)** | |
| ICE | NONE |
| CLUTCH 1 | NONE |
| CLUTCH2 | NONE |
| MOTOR 1-TRACTION/ GEN | TRACTION ON |
| MOTOR 2 - TRACTION/ GEN | TRACTION ON |
| BATTERY STATE | DISCHARGING |
| **6. WAKEBOARD/ TUBE MODE -** | (T3) |
| **(~22 mph)** | |
| ICE | NONE |
| CLUTCH 1 | NONE |
| CLUTCH2 | NONE |
| MOTOR 1-TRACTION/ GEN | TRACTION ON |
| MOTOR 2 - TRACTION/ GEN | TRACTION ON |
| BATTERY STATE | DISCHARGING |

FIG. 9B

| | |
|---|---|
| **AXIAL FLUX MOTOR - OPERATION MODES** | |
| OPERATION MODE | **100% ELECTRIC** |
| **7. CRUISE MODE -** | (T2) |
| **(23+ mph)** | |
| ICE | NONE |
| CLUTCH 1 | NONE |
| CLUTCH2 | NONE |
| MOTOR 1-TRACTION/ GEN | TRACTION ON |
| MOTOR 2 - TRACTION/ GEN | TRACTION ON |
| BATTERY STATE | DISCHARGING |
| | |
| **8. WIDE OPEN THROTTLE -** | (T2) |
| **(WOT)** | |
| ICE | NONE |
| CLUTCH 1 | NONE |
| CLUTCH2 | NONE |
| MOTOR 1-TRACTION/ GEN | TRACTION ON |
| MOTOR 2 - TRACTION/ GEN | TRACTION ON |
| BATTERY STATE | DISCHARGING |

FIG. 9C

AXIAL FLUX PROPULSION SYSTEM FOR AN ELECTRIC BOAT

CROSS REFERENCE TO RELATED APPLICATIONS

This application is a Continuation-In-Part of U.S. application Ser. No. 17/120,106, filed Dec. 11, 2020, which claims the benefit of U.S. Provisional Application No. 62/946,478 filed Dec. 11, 2019.

FIELD OF THE APPARATUS AND METHOD

The invention relates to the field of electrically propelled boats.

BACKGROUND OF THE INVENTION

Axial Flux motors have been known and used for decades as shown, for example, in U.S. Pat. No. 5,109,172 which is titled "Permanent Magnet Motor Having Diverting Magnets", which was issued in April 1992.

Early use of axial flux in devices was primarily as sensors (such as transducers). As more powerful axial flux devices were developed, Axial Flux motors were created and deployed.

Prior use of Axial Flux motors in marine propulsion includes for example, U.S. Pat. No. 5,229,677 titled "Electric Propulsion Motor for Marine Vehicles" issued July 1993.

An example of an axial flux motor/generator for marine vehicles is provided by U.S. Pat. No. 5,229,677 (Dade et al) where the motor/generator has an axial gap design with a disk-shaped rotor and two disk-shaped stators.

Further, it is known that axial flux motor/generators provide more power and density, due to smaller size and the alignment of the rotor and stator coils as well as the flux field generator, than radial flux motors.

BRIEF SUMMARY OF THE INVENTION

It is an object of the invention to provide an axial flux propulsion system for an electric boat.

It is further an object of the invention to provide an electric boat having an axial flux propulsion system.

BRIEF DESCRIPTION OF THE DRAWINGS

The apparatus will be better understood when consideration is given to the following detailed description thereof.

FIG. IA presents a top view of an axial flux propulsion system having multiple axial flux motor/generators.

FIG. IB presents side cutaway view of an axial flux propulsion system having multiple axial flux motor/generators.

Figure 1A:
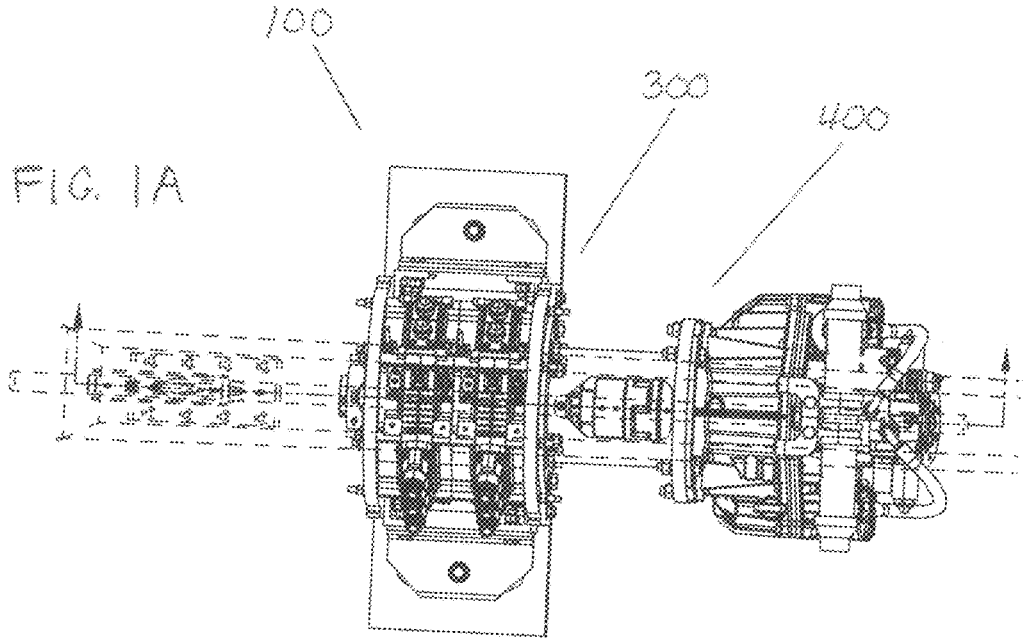
Figure 1B:
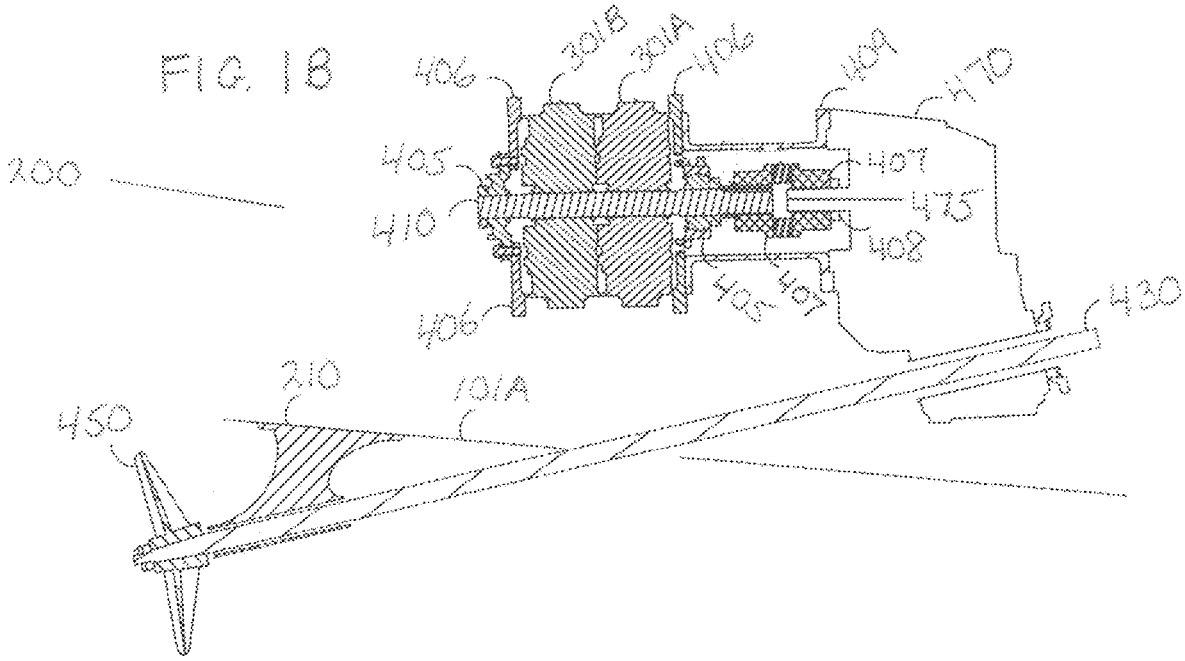
Figure 1C:
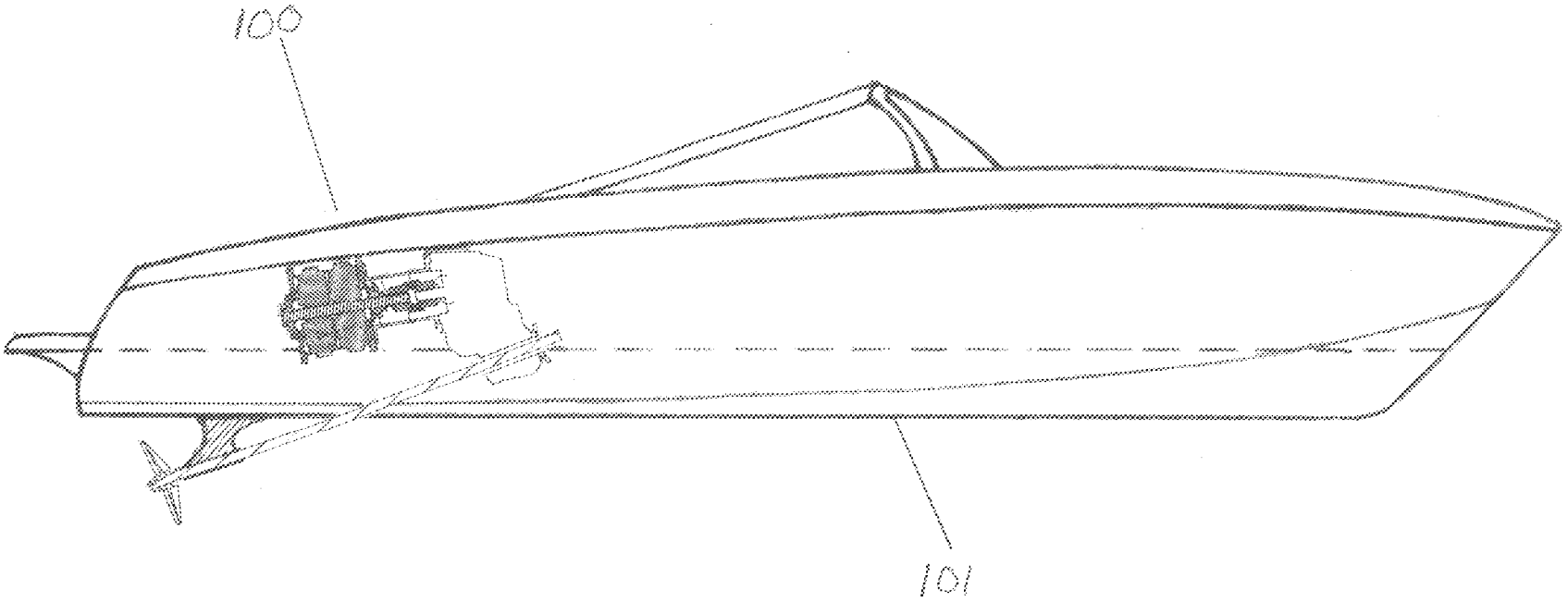

FIG. 1C presents side cutaway view of an axial flux propulsion system having multiple axial flux motor/generators positioned within a boat.

Figure 1D:
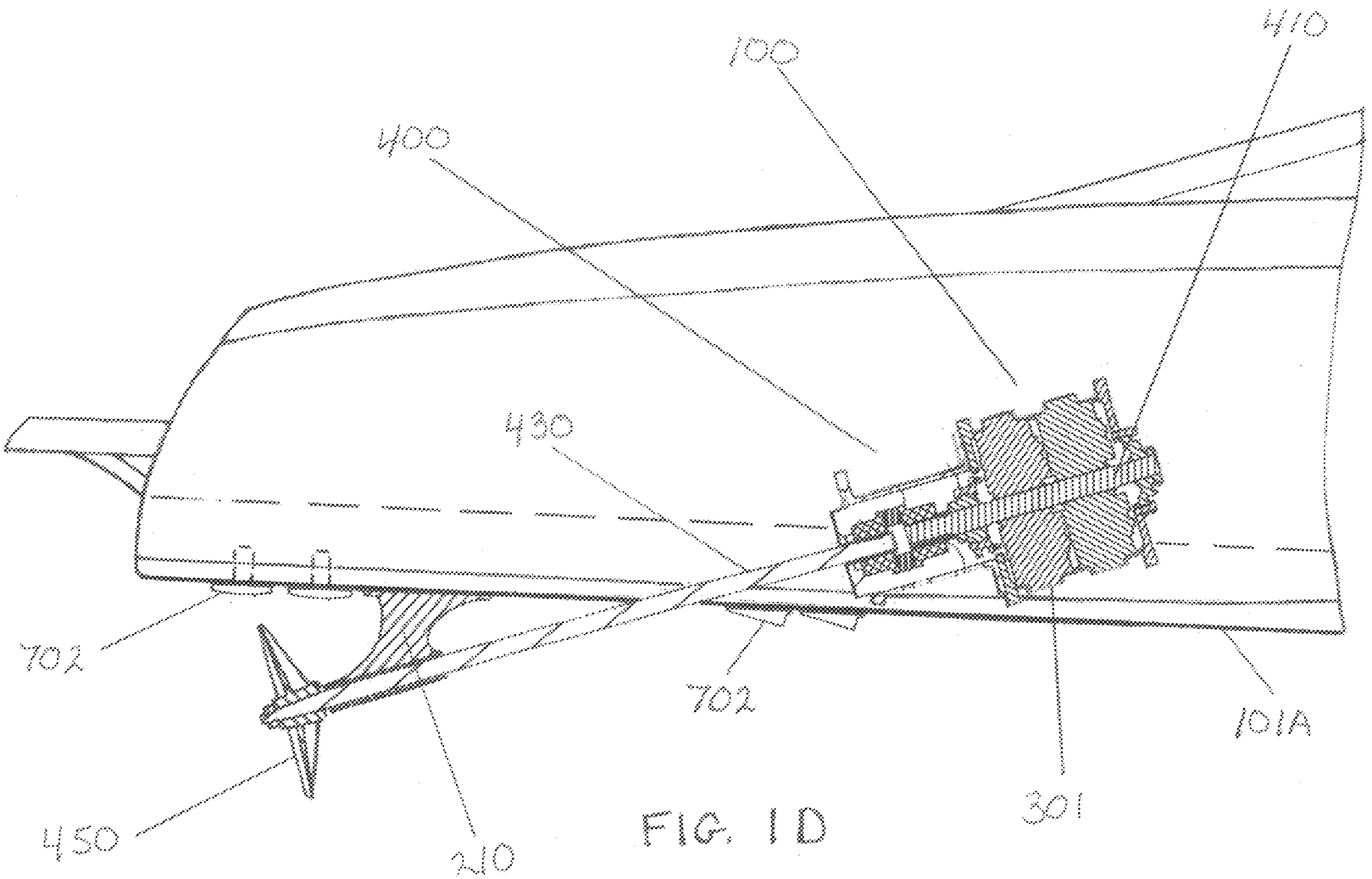

FIG. 1D presents side cutaway view of an axial flux propulsion system having multiple axial flux motor/generators positioned within a boat.

Figure 2A:
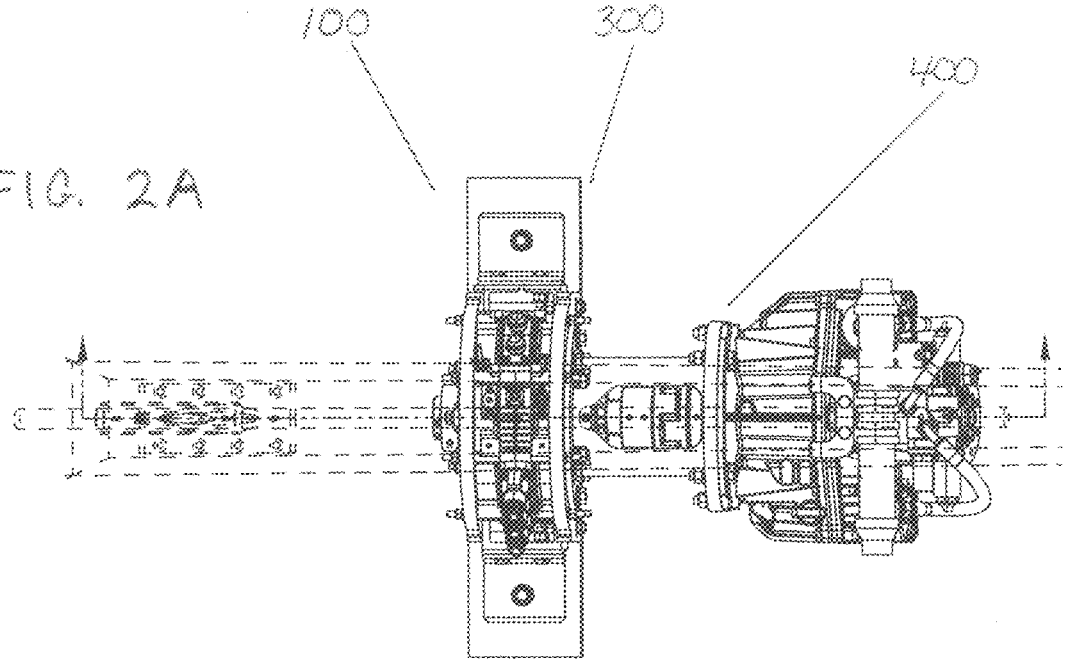

FIG. 2A presents a top view of an axial flux propulsion system having one axial flux motor/generator.

Figure 2B:
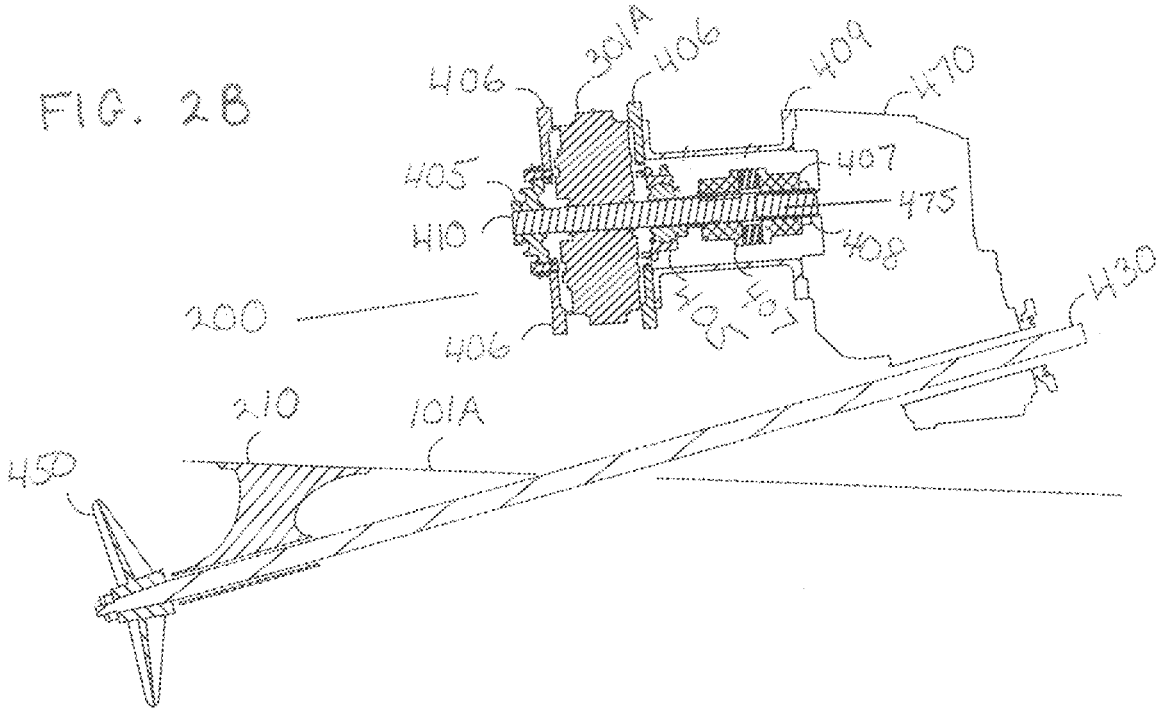

FIG. 2B presents side cutaway view of an axial flux propulsion system having one axial flux motor/generator.

Figure 3:
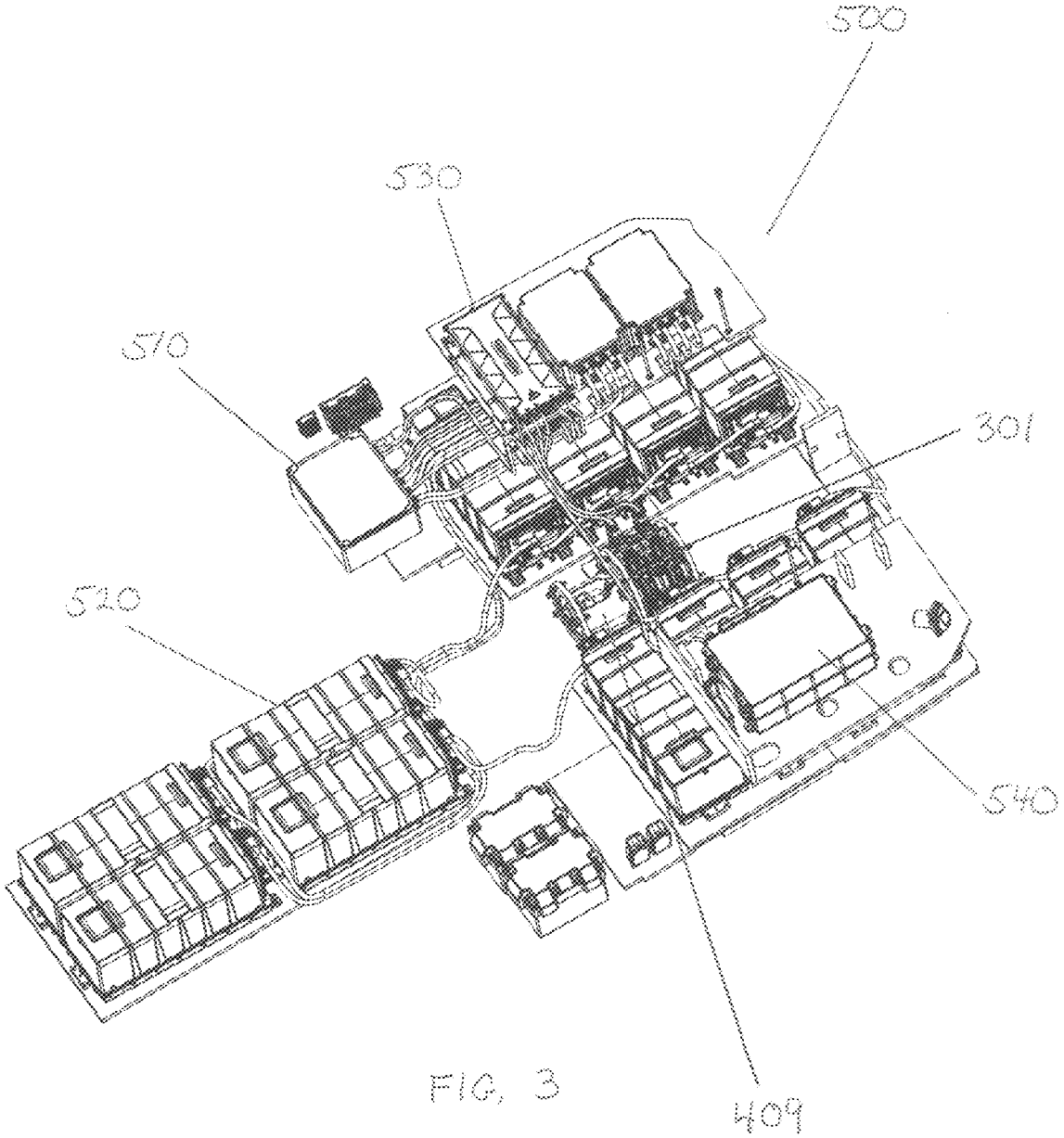

FIG. 3 presents a perspective view of an axial flux propulsion system.

Figure 4:
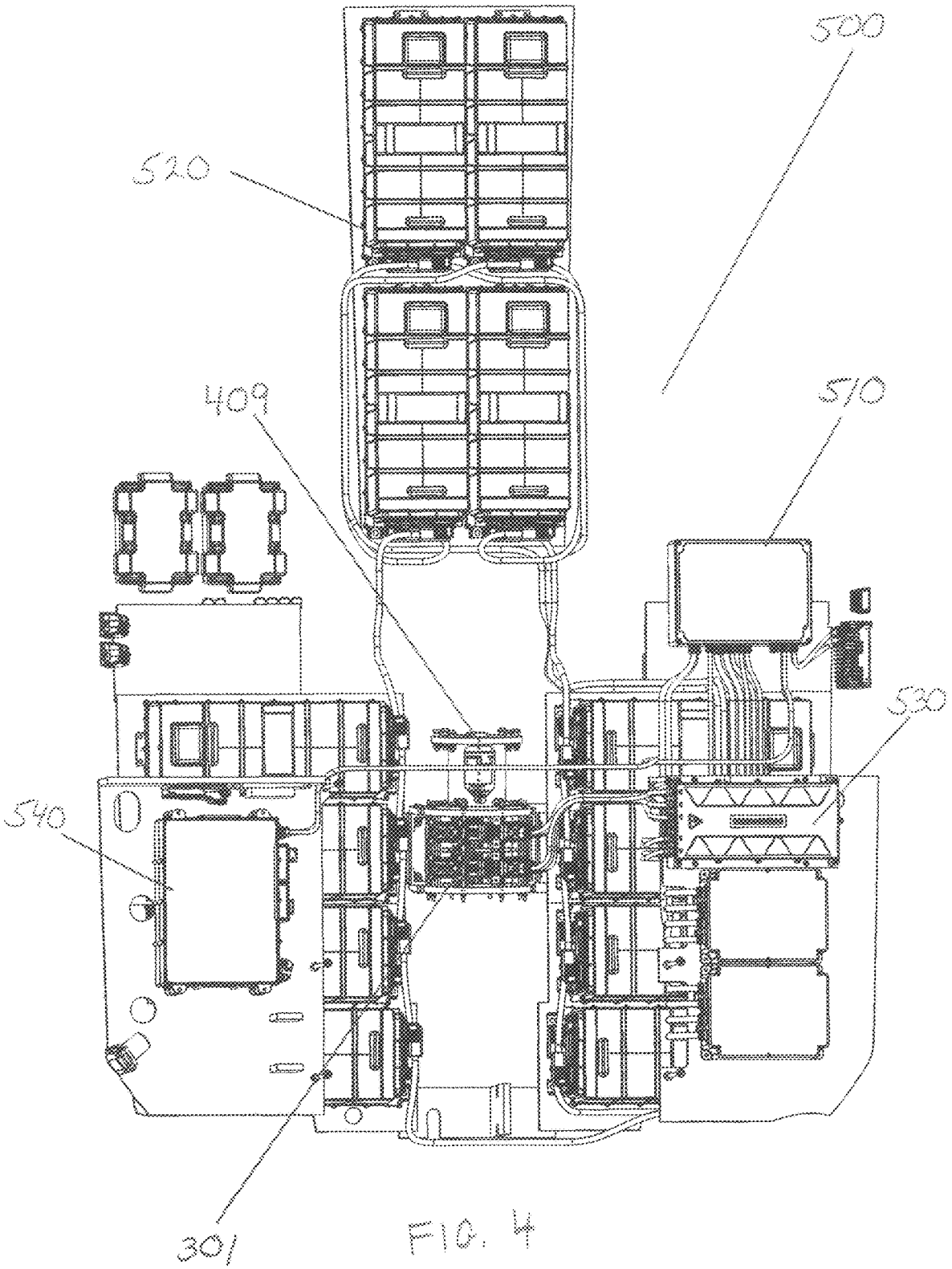

FIG. 4 presents a perspective view of an axial flux propulsion system.

Figure 5:
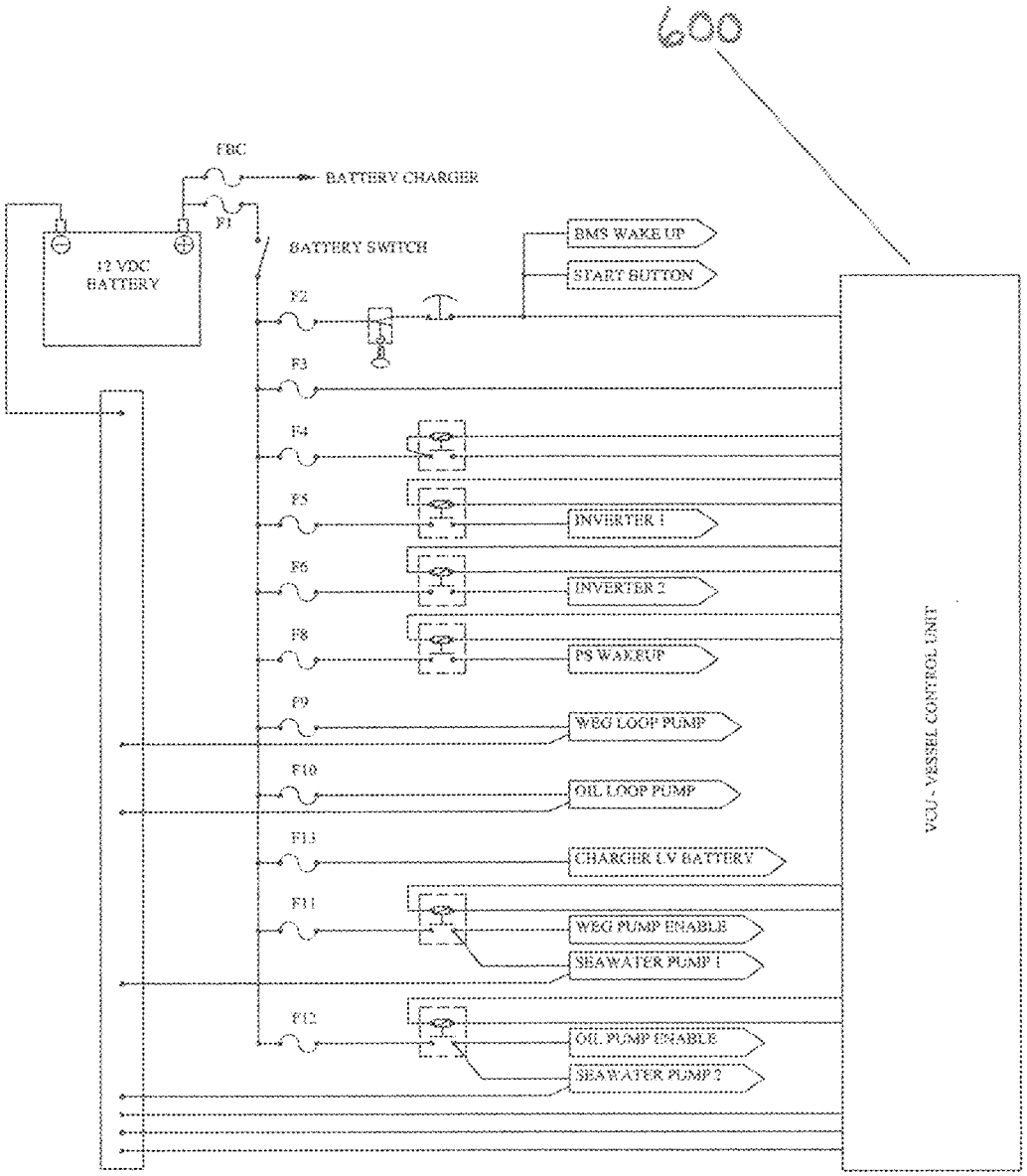

FIG. 5 presents a low power circuit and Control System elements.

Figure 6A:
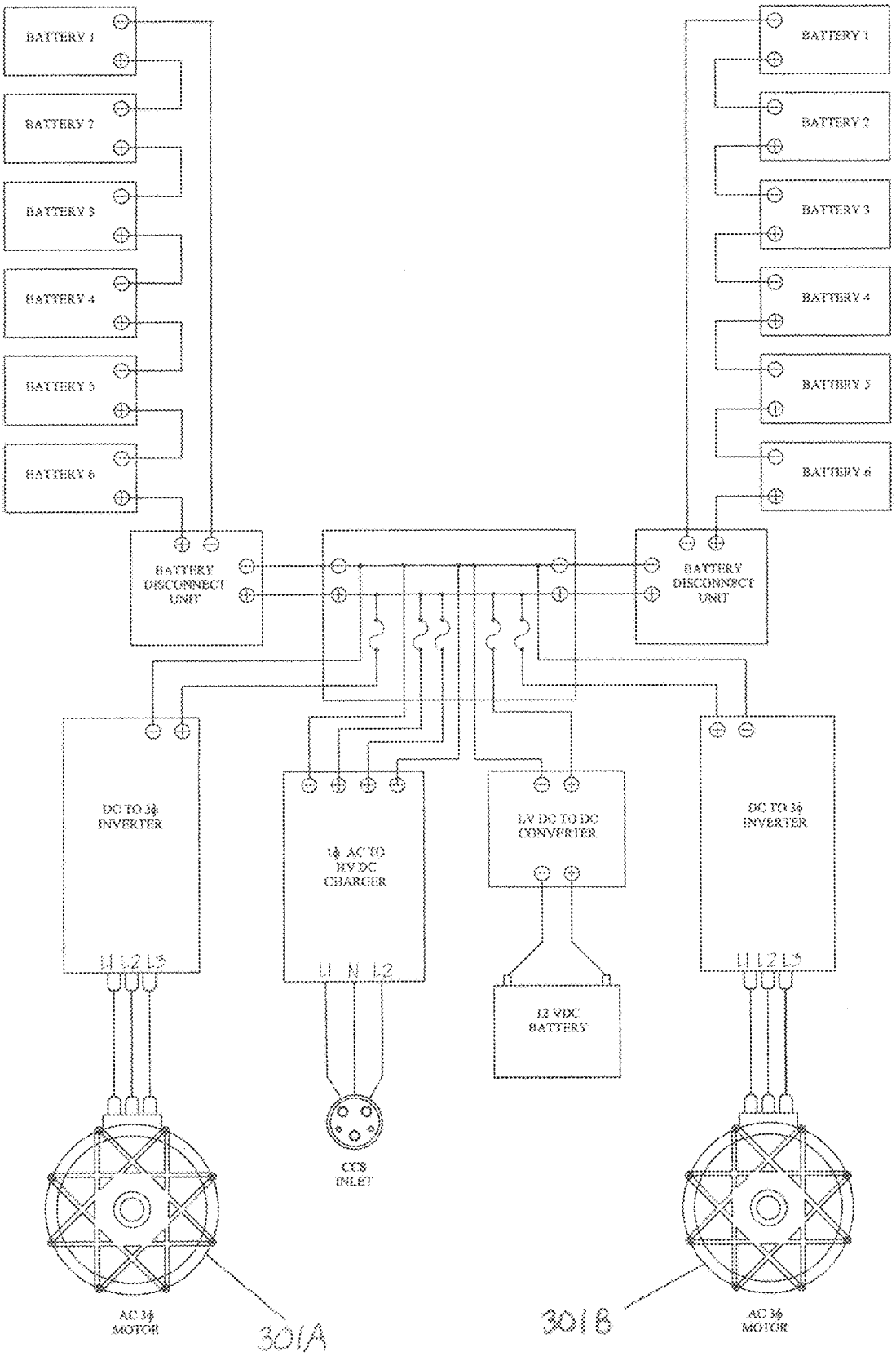

FIG. 6A presents a high-power circuit for multiple axial flux motor/generators.

Figure 6B:
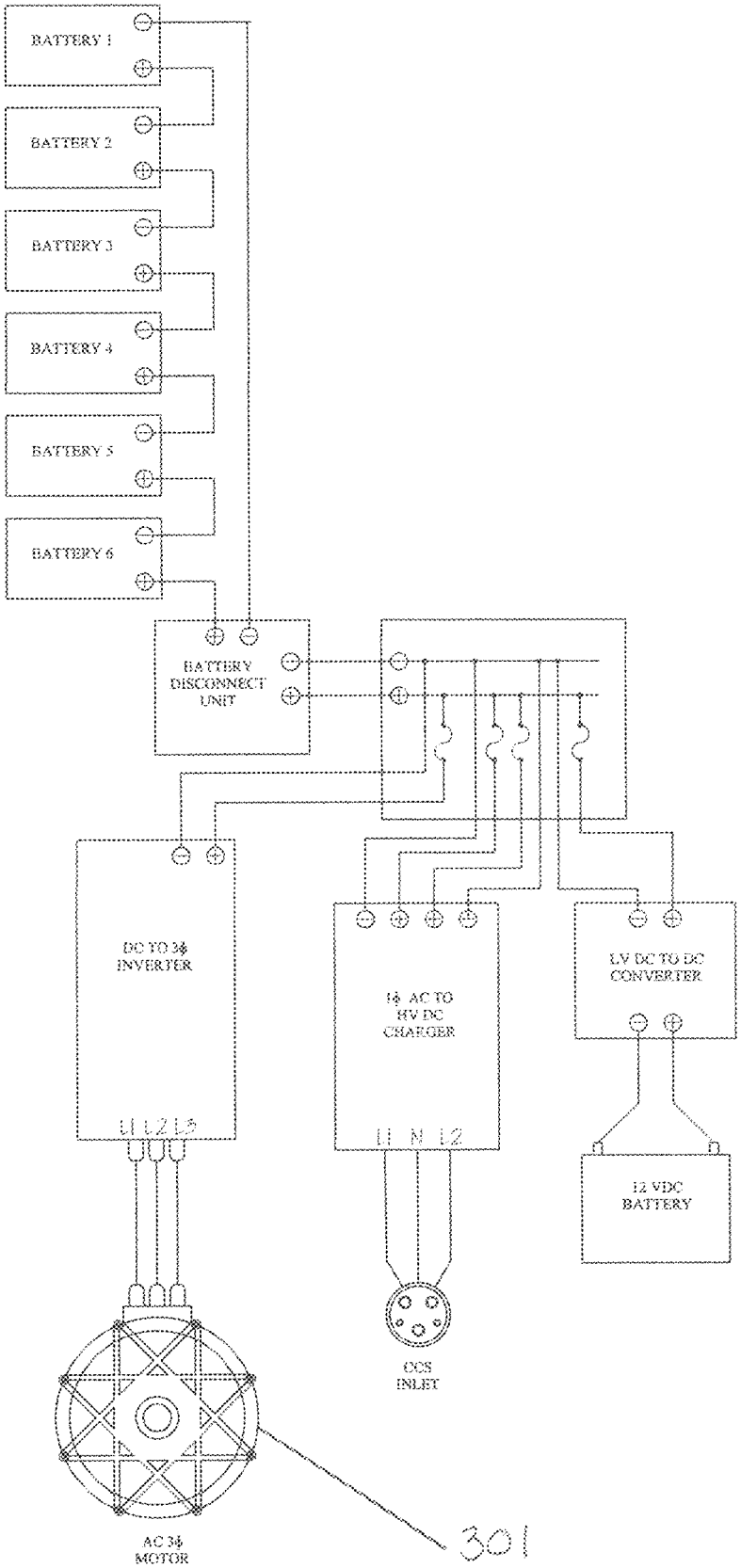

FIG. 6B presents a high-power circuit for a single axial flux motor/generator.

Figure 7:
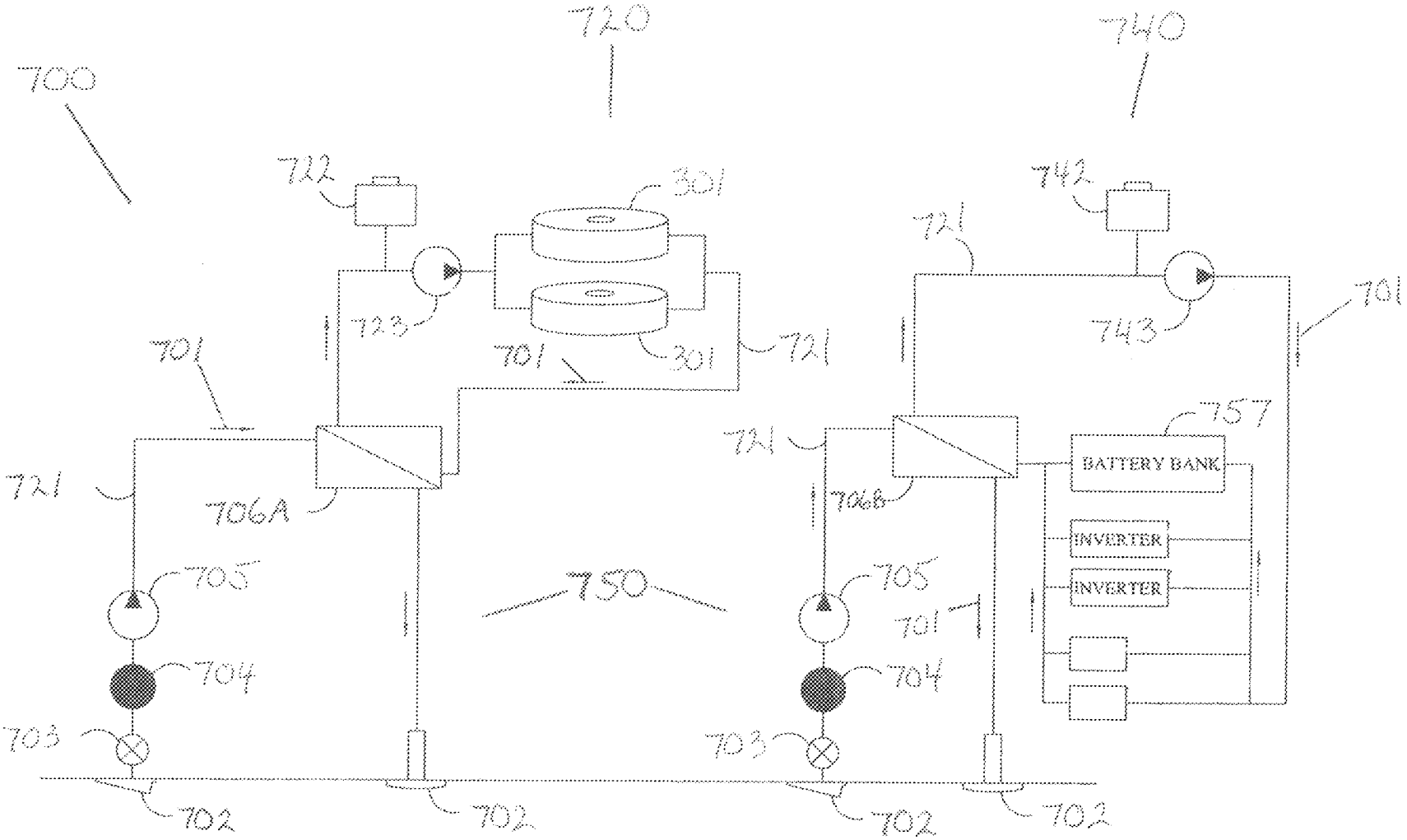

FIG. 7 presents the cooling system of the axial flux propulsion system.

Figure 8:
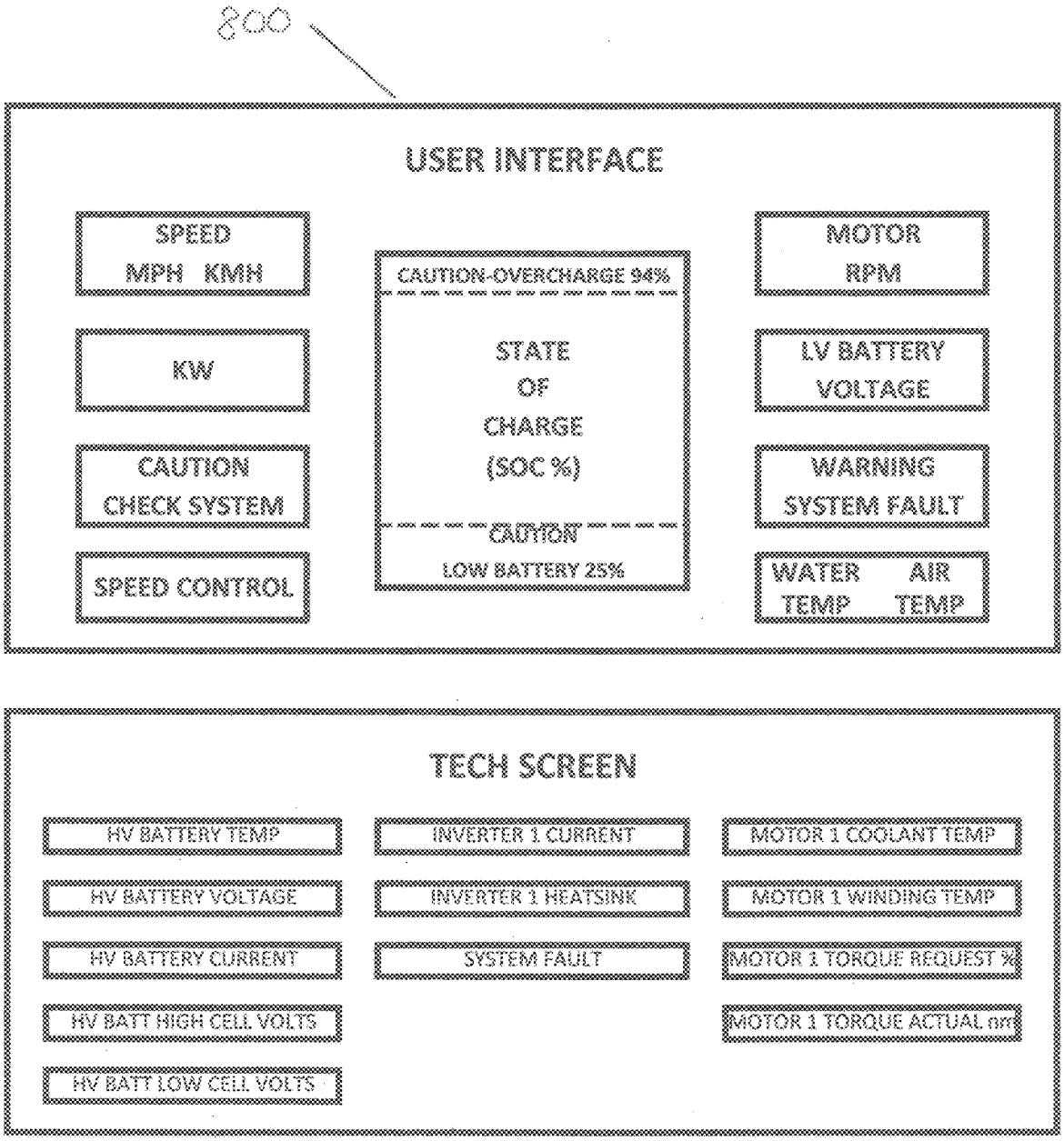

FIG. 8 presents the Graphical User Interface of the axial flux propulsion system.

FIGS. 9A, 9B, and 9C presents the tables which indicate the status of the axial flux propulsion system during various stages of operation.

Figure 10:
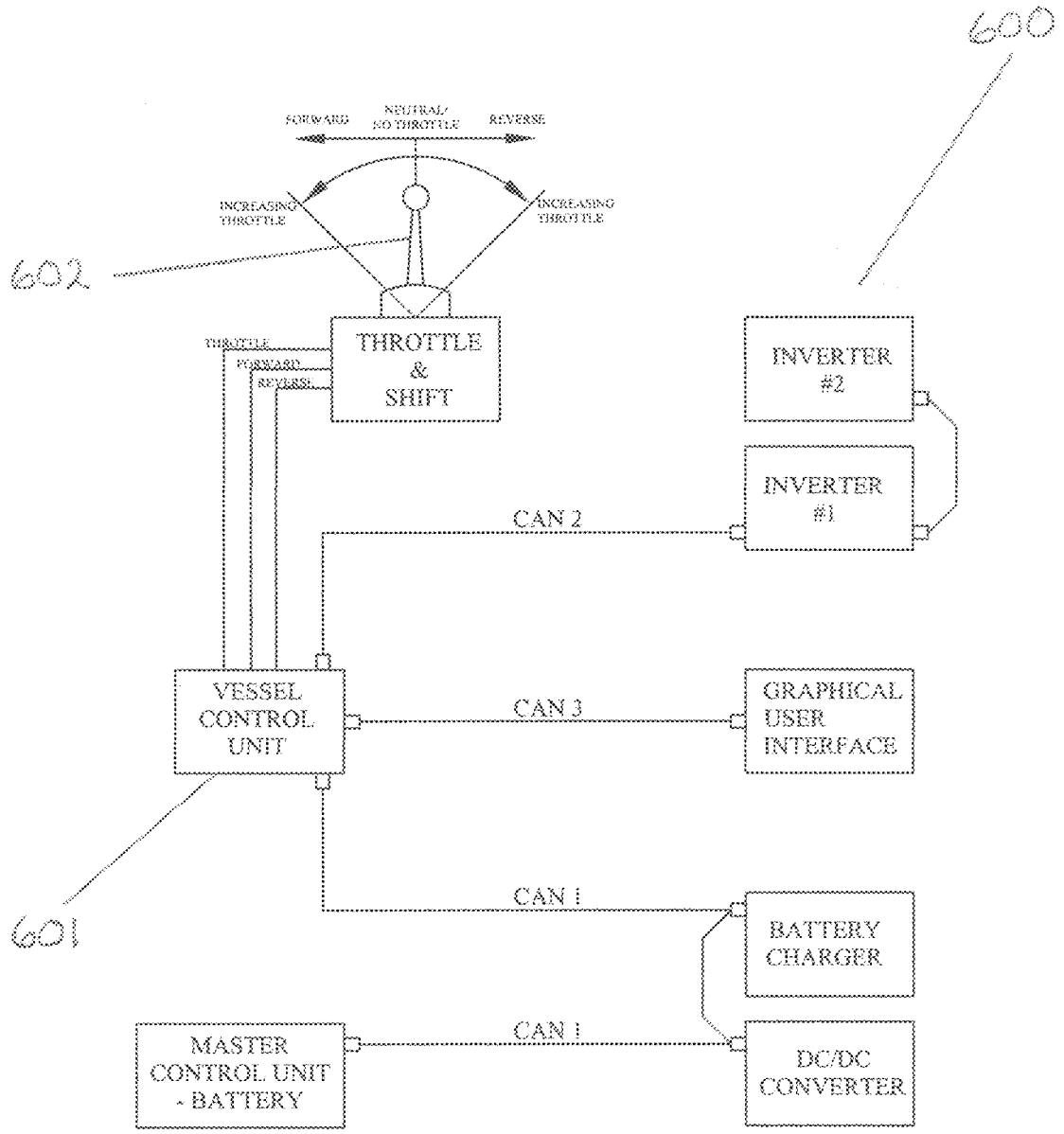

FIG. 10 presents a diagram of control system components.

DETAILED DESCRIPTION OF THE INVENTION

The invention of an Axial Flux Propulsion System (100) for an Electric Boat (101) is provided herein and in FIGS. 1A-10. The Axial Flux Propulsion System (100) has interconnecting subsystems including a mounting system (200), a traction system (300), a transmission system (400), an electrical power distribution system (500), a control system (600), and a fluid management system (700) among other boat (101) systems. The Axial Flux Propulsion System (100) is positioned within a boat hull (101A) to provide propulsion for the boat (101).

In overall operation the traction system 300, via the transmission system (400) imparts force to a propeller (450) which produces thrust when the propeller is submerged in a liquid (such as water).

Specifically, the preferred embodiment presents an axial flux propulsion system for an electric boat comprising: a mounting system (200) for supporting components of the propulsion system, the mounting system (200) including at least a drive shaft support strut (210).

The axial flux propulsion system (100) further includes a traction system (300) for generating torque, the traction system (300) including at least one axial flux electric motor/generator (301).

The axial flux propulsion system (100) further includes a transmission system (400) for transmitting torque, the transmission system (400) including at least a transmission shaft (410), a drive shaft (430), and a propeller (450).

The axial flux propulsion system (100) further includes an electrical power distribution system (500) for storing and distributing electrical power, the electrical power distribution system (500) including at least one battery (520).

The axial flux propulsion system (100) further includes a control system (600) which including at least a communication system (601) and a throttle (602) that together direct the operation of boat subsystems. the control system (600) directs the electrical power distribution system (500) to increase, decrease, or suspend electrical power (including at least current, voltage, frequency, or phase) to the system (400), in response to signals from the throttle (602) and communication system (601).

The axial flux propulsion system (100) further includes a fluid management system (700) for cooling components of the propulsion system, the fluid management system (700) including at least one fluid flow path (701).

The axial flux propulsion system (100) further includes wherein the at least one axial flux electric motor/generator (301) is positioned on the transmission shaft (410) which is coupled to the drive shaft (430) which itself is positioned on the drive shaft support strut (210) and coupled to the propeller (450).

The axial flux propulsion system (100) further includes a Graphical User Interface (800). As shown in FIG. 8, the Graphical User Interface (800) provides a visual display of the important information about the state of the vehicle subsystems as well as general information such as date and time. The Graphical User Interface (800) (also referred to as a display or a gui) also provides the boater access to speed control used to set the speed at a specific mph (or other related motion designations). The boat (101) is brought on plane and proceeds at a speed that approximates the desired mph. The "SPEED CONTROL" button is pressed on the display (800), then adjusted "UP" or "DOWN" to set the desired speed. To turn the speed control off the driver either presses the "OFF" button on the display or decelerates the boat.

The Graphical User Interface (800), as shown in FIG. 8, can also be toggled to display system information on a "TECH SCREEN" which is used during maintenance and troubleshoot of the system. It is understood the Graphical User Interface (800) can be configured to provide various categorizations and grouping of information and operational options for user inputs (such as the "SPEED CONTROL" function) without providing all information display options.

As shown in FIG. 1A, a first alternate embodiment of the Axial Flux Propulsion System (100) for an Electric Boat (101) further includes wherein the traction system (300) includes a first axial flux electric motor/generator (301A) positioned adjacent to a second axial flux electric motor/generator (301B) wherein both motor/generators (301A, 301B) are positioned on the common transmission shaft (410), and wherein the first and second motor/generators (301A, 301B) can operate in unison or independent of each other, as directed by the control system (600).

The axial flux motor/generators (301A, 301B) are supported at their central core region on the common transmission shaft (410), as shown in FIG. 1A-2B. Note—one or more than one axial flux motor (301A,301B) may be used. The transmission shaft (410) is supported by a pair of support bearings (405) which are positioned on motor mounts (406). The motor mounts (406) are attached to the boat hull. The transmission shaft (410) extends into the shaft coupling (407). The transmission shaft (410) is coupled to a transmission box stub (475) by a shaft coupling (407) and collar (408). The transmission box stub (475) is mechanically linked within the transmission box (470) to the drive shaft (430). The transmission shaft (410) and transmission box stub (475) are enclosed in a shaft housing (409) which is attached to a motor mount (406) and the transmission box (470). The drive shaft (430) is coupled to and imparts torque to the propeller (450). In operation the torque from the axial flux motor (301) is applied to the transmission shaft (410) which is then coupled to the transmission box (470) via the transmission box stub (475). The transmission box (470) then transmits the torque to the drive shaft (430) which turns the propeller (450) and provide propulsion for the boat (101).

The Electrical Power Distribution System

The electrical power distribution system (500) is responsible for managing the delivery of power from the batteries to the axial flux motor/generators (301) and as well as for storing and distributing electrical power throughout the boat, as shown in FIGS. 5, 6A, and 6B.

The electrical power distribution system (500) includes at least one battery (520).

The electrical power distribution system (500) further includes generally known electric vehicle power distribution equipment including inverters, converters, chargers, a connection bus, battery disconnect units, safety circuit breakers, fuses, temperature sensors, battery condition sensors, voltage sensors, current sensors, frequency sensing, power, current, and voltage conditioning circuitry, power system condition indicating elements (such as lights or electronic messaging). Typically, the at least one battery is a bank of batteries.

In an exemplary configuration, the power distribution unit (510) of the electrical power system (500) provides the axial flux motor/generators (301) current and voltage drawn from at least one battery (520) (preferably high voltage battery packs). At least one inverter (530) and at least one charger (540) assist in conditioning and distributing power throughout the electrical power system (500).

The Control System

The control system (600), as shown in 5, 6A, and 6B, includes at least a communication system (601) and a throttle (602) that together direct the operation of boat subsystems such as directing the electrical power distribution system (500) to increase, decrease, or suspend electrical power to the system (400), in response to signals from the throttle (602) and communication system (601). The control system (600) monitors the subsystems for faults and directs the appropriate response to the fault.

The control system (600)—also referred to as the Vessel Control Unit (VCU)—see FIGS. 5, 6A, 6B uses, as applicable, Controller Area Network (CAN) bus protocols (including at least CAN 2.0 and CAN FD—Flexible Data-Rate), the National Marine Electronics Association (NMEA) standard 2000 and NMEA 0183 standard. Additionally, as needed, vehicle control communications can be performed using Bluetooth, Wi-Fi, 5G thru 1G, Near Field Communications (NFC), Satellites, Optics, and other known technologies.

As shown in FIGS. 6A and 6B, the axial flux motor is an AC, 3 phase motor/generator which receives power from a bank of batteries via the CAN bus.

The Fluid Management System

The fluid management system (700), as shown in FIG. 7, includes a raw water subsystem (750), a motor cooling subsystem (720), and a battery cooling subsystem (740) and provides independent, autonomous cooling of the separate cooling subsystems. The fluid management system (700) includes as least one fluid flow path (701) for circulating cooling fluid and uses a variety of fluids including raw water intake fluid (such as raw water) from boat ports (702) provided on the boat hull. Temperature sensors (not shown) are distributed throughout the fluid management system (700) to provide temperature information of the applicable fluids or the temperature of system elements.

Further the fluid management system (700) subsystems use a predetermined Water, Ethanol, Glycol (WEG) solution, and/or a predetermined Dielectric Oil solution. It is understood the choices of features such as fluid chosen, fluid path elements, and equipment for monitoring and/or controlling the fluid flow is made in consideration of the cooling or heating requirements as presented by the fluid management system component manufacturers.

Once the boat is lowered into a body of water (such as a lake) the boat ports (702) below the waterline direct or push raw water into a hull boat port (702) and into the raw water subsystem (750) of the fluid management system (700).

Within the raw water subsystem (750), a seacock valve (703) is used to control the flow of raw water further into the fluid management system (700). With the seacock valve (703) closed, no raw water can further enter the fluid management system (700) from the boat port (702). With the seacock valve (703) open, raw water can further enter the fluid management system (700) from the boat port (702). A sea strainer (704) is provided in the fluid flow path (701) after the seacock valve (703) to minimize foreign objects entering the raw water subsystem (750) with the raw water.

After the raw water is strained of debris an intake circuit pump (705) pumps/directs the raw water (or other fluid) to a heat exchanger (706) where the raw water impinges on surfaces within the heat exchanger (706) and draws heat away from the internal heat exchanger surfaces. The raw water enters the heat exchanger at a lower temperature than it is when the water exits the heat exchanger. This warmed raw water is expelled from the heat exchanger (706) along a fluid flow path (701) that exits the boat hull through a boat port (702).

The motor cooling subsystem (720)—(which is electronically monitored/controlled by the control system 600)—includes a motor cooling subsystem reservoir (722), a motor cooling subsystem circulating pump (723), and a motor cooling subsystem heat exchanger (706A).

Within the motor cooling subsystem (720) the working fluid (721) is determined based on the specifications provided by the motor manufacturer to optimize motor operation. It is understood changes in the number of motors of the size or features of a motor may require appropriate changes to the motor cooling subsystem (720).

In typical operation, the motor cooling subsystem circulating pump (723) continually circulates the working fluid (721) within the motor cooling subsystem (720). The reservoir (722) provides a high enough fluid level buffer to maintain a constant flow of circulating working fluid (721). As the working fluid (721) flows through the interior of each axial flux motor (301) the fluid draws heat from the motor components. The heated working fluid (721) exits the axial flux motor (301) and is directed through the heat exchanger (706A) where the heated working fluid (721) transfers its heat to the cooler raw water circulating within the raw water subsystem (750).

The battery cooling subsystem (740)—(which is electronically monitored/controlled by the control system 600)—includes a battery cooling subsystem reservoir (742), battery cooling subsystem circulating pump (743), and a battery cooling subsystem heat exchanger (706B). The battery cooling system (740) cools battery system components (757) which may include, among other things, an on-board charger, a de/de converter, inverters, and banks of batteries.

Within the battery cooling subsystem (740) the working fluid is determined based on the specifications provided by the battery systems manufacturer to optimize battery operation. It is understood changes in the number of batteries, their size, or features may require appropriate changes to the battery cooling subsystem (740).

In typical operation the battery cooling subsystem, the circulating pump (743) continually circulates the working fluid (721) within the battery cooling subsystem (740). The reservoir (742) provides a high enough fluid level buffer to maintain a constant flow of circulating working fluid (721). As the working fluid (721) flows through the interior of each battery system component (757) the fluid draws heat from the respective components. The heated working fluid (721) exits the battery system components (757) and is directed through the heat exchanger (706B) where the heated working fluid (721) transfers its heat to the cooler raw water circulating within the raw water subsystem (750).

General Theory of Operation

Startup

During Axial Flux Propulsion System (100) startup (as used with a boat), the throttle is positioned straight up in neutral (referred to herein as TO), and the subsystems are turned on. The Axial Flux Propulsion System (100) provides time for subsystems to stabilize as applicable. For example, cooling loop pumps are given time to circulate fluid to the batteries (520), the inverters (530), and motor/generators (301) among other components.

Within the startup period the control system (600) confirms the subsystems are ready for operation. During this period fault indications are processed, and the current status of various subsystems is provided on the Graphical User Interface (800) which can be removably positioned anywhere suitable on the boat (such as the dashboard).

Boaters generally use the subsystem status information of the Graphical User Interface (800) for planning their boating activities. For example, by reviewing the remaining State-Of-Charge (SOC) a boater can estimate the battery drain of various boating activities and chose accordingly.

Thus, upon initial startup, the applicable subsystems are turned on however the traction system (300) is not yet engaged nor are the motor/generator motors (301) on.

Idle

After the subsystems are appropriately initiated, the boater shifts the throttle (602) to a forward idle detent position from the neutral position (TO), referred to herein as T1 in order to slowly guide the boat forward. Note—movement of the throttle sends a signal to the control system (600) to power the axial flux motor/generator (301) on, off, or to increase or decrease the speed. Alternative methods for turning the motors on or off may include a start/stop button or mechanical switch or other known similar on/off type devices. The boater may also shift the throttle (602) to a reverse idle detent to slowly idle backward (T4) and can increase reverse speed by moving the throttle (602) further back (T5).

Running Speed

The boater can adjust the boat running speed, referred to herein as T2, as desired by pushing the throttle (602) forward to increase boat speed or by pulling the throttle (602) back to decrease boat speed. Throttle (602) detent positions (not shown) may be provided to incrementally adjust the boat speed.

Preset Speeds

Boaters can maintain boat speed (referred to herein as T3) and enter a preset speed limit or manually adjusted boat speed (T3) range (including using a control system algorithm or GPS speed control, such as to maintain the boat under 5 mph or near 10.8 mph for wake surfing).

Back to Idle

From the preset speed (T3) boaters can move the throttle (602) to decelerate the boat back into Idle or accelerate back up to running speed (T2). When the boat is shifted back into Neutral (T1 to TO) the engagement of the motor/generator(s) (301) is released.

System Shut Off

After shifting to Neutral the boater can turn the boat off. The system may include a shut-down delay allowing the subsystems to shut down in an organized manner.

General Subsystems and Operations

The propulsive force of the Axial Flux Propulsion System (100) of the preferred embodiment of the instant invention is provided by at least one axial flux motor/generator (301) which is connected to the transmission system (400) via a transmission shaft (410) which extends through the core region of the axial flux motor/generator (301) to the propeller (450).

FIG. 9(A,B,C) presents tables which indicate the status of the axial flux propulsion system during various stages of operation. Importantly, note that during specified stages axial flux motor/generators may be present but disengaged or engaged, charging or discharging, applying traction or not among other conditions.

Of particular note is that each axial flux motor/generator (301) can be used as either a motor—applying torque or as a generator which is driven by a source of torque.

Further, the axial flux motor/generators (301) can be selectively operated as generators for at least a portion of their usage time.

Further, supplemental propulsive force of the Axial Flux Propulsion System (100) may be provided by an engine (internal combustion, Wankel, Stirling, steam, nucleonic, microwave, human powered, pneumatic, hydraulic, wind, biofuel, microbial, and aquatic, at least).

As shown in the FIG. 9 (A, B, C), selection of the torque and power engagement of the transmission system 400 is performed via the throttle (602). Operation Modes of each embodiment are provided in FIG. 9. The operational modes selectable by the throttle and programmed into the control system 600 are listed below with status information of the relevant key system components.

The axial flux motor/generators can be used in conjunction with one or more clutches to allow for more selective engagement of motors to provide additional torque. Further, the use of clutches allows the selective use of either motor functions (such as providing torque) or generator functions (such as for charging batteries or powering subsystems).

Within the marine industry, and in particular within the wakeboarding field, optimizing the use of the propulsion system to provide either torque or battery charging energy presents a new range of functionality where boaters can alternate between boat use periods and boat system charging periods as desired or as applicable.

For example, boat users can wakeboard for an hour or two and then rest for an hour or two while the axial flux propulsions system is charged.

The boat users can selectively determine how long to wakeboard with consideration for the recharging period and plan accordingly.

Further, with the proliferation of various electric vehicle charging stations and charging equipment, the axial flux propulsions system for an electric boat of the instant invention is presented with ever-widening charging options.

Other novel features which are characteristic of the apparatus, as to organization and method of operation, together with further objects and advantages thereof are better understood from the preceding description considered in connection with the accompanying figures and claims but is not intended as a definition of the limits of the apparatus.

What is claimed is:

1. An axial flux propulsion system for an electric boat comprising:

a mounting system for supporting components of the propulsion system, the mounting system including at least a drive shaft support strut;

a traction system for generating torque, the traction system including at least one axial flux electric traction motor/generator;

a transmission system for transmitting torque, the transmission system including at least a transmission shaft, a drive shaft, and a propeller;

an electrical power distribution system for storing and distributing electrical power, the electrical power distribution system including at least one battery; and a control system which including at least a communication system and a throttle that together direct the operation of boat subsystems;

wherein the at least one axial flux electric traction motor/generator is positioned on the transmission shaft which is coupled to the drive shaft which itself is positioned on the drive shaft support strut and coupled to the propeller;

wherein the control system directs the electrical power distribution system to increase, decrease, or suspend electrical power (including at least current, voltage, frequency, or phase) to the traction system, in response to signals from the throttle and communication system;

wherein the boat subsystems include at least the mounting system, the traction system the transmission system, the electrical power distribution system and the control system; and wherein the traction system is a purely electric motor system.

2. The axial flux propulsion system of claim 1 wherein the propulsion system is positioned within a boat hull to provide propulsion for the boat.

3. The axial flux propulsion system of claim 2 wherein the traction system includes a first axial flux electric traction motor/generator positioned adjacent to a second axial flux electric traction motor/generator;

wherein both motor/generators are positioned on the transmission shaft, and wherein the first and second motor/generators can operate in unison or independent of each other, as directed by the control system.

4. The axial flux propulsion system of claim 3 further including a transmission box positioned between the transmission shaft and the drive shaft the transmission box transmitting torque from the applicable axial flux electric traction motor/generator.

5. The axial flux propulsion system of claim 1 further including a fluid management system for cooling system components.

6. An axial flux propulsion system for an electric boat comprising:

a mounting system for supporting components of the propulsion system, the mounting system including at least a drive shaft support strut;

a traction system for generating torque, the traction system including at least a first axial flux electric traction motor/generator and a second axial flux electric traction motor/generator;

a transmission system for transmitting torque, the transmission system including at least a transmission shaft, a drive shaft, and a propeller;

an electrical power distribution system for storing and distributing electrical power, the electrical power distribution system including at least one battery; and a control system which including at least a communication system and a throttle that together direct the operation of boat subsystems;

wherein the at least one axial flux electric traction motor/generator is positioned on the transmission shaft which is coupled to the drive shaft which itself is positioned on the drive shaft support strut and coupled to the propeller;

wherein the control system directs the electrical power distribution system to increase, decrease, or suspend electrical power (including at least current, voltage, frequency, or phase to the traction system, in response to signals from the throttle and communication system;

wherein the boat subsystems include at least the mounting system, the traction system, the transmission system, the electrical power distribution system, and the control system; and wherein the transmission shaft is a single, continuous shaft that is mounted to both of the first axial flux electric traction motor/generator and the second axial flux electric traction motor/generator.

7. The axial flux propulsion system of claim 6 wherein the first axial flux electric traction motor/generator is positioned directly adjacent to the second axial flux electric traction motor/generator.

8. The axial flux propulsion system of claim 6 wherein the first axial flux electric traction motor/generator is positioned adjacent to the second axial flux electric traction motor/generator without any intervening components.

9. The axial flux propulsion system of claim 1 wherein the traction system includes a first axial flux electric traction motor/generator positioned adjacent to a second axial flux electric traction motor/generator; and wherein the first and second motor/generators can operate in unison or independently of each other, as directed by the control system.

10. The axial flux propulsion system of claim 9 wherein the first axial flux electric traction motor/generator and the second axial flux electric traction motor/generator share engine mounts and bearings.

11. The axial flux propulsion system of claim 6 wherein the first axial flux electric traction motor/generator and the second axial flux electric traction motor/generator share engine mounts and bearings.

* * * * *